US006708356B1

(12) United States Patent
LaValle

(10) Patent No.: US 6,708,356 B1
(45) Date of Patent: Mar. 23, 2004

(54) BEDDING ARTICLE

(76) Inventor: Laura A. LaValle, 2 Valley Hill Rd., Pelham, NH (US) 03076

( * ) Notice: Subject to any disclaimer, the term of this patent is extended or adjusted under 35 U.S.C. 154(b) by 0 days.

(21) Appl. No.: 10/310,444

(22) Filed: Dec. 5, 2002

(51) Int. Cl.[7] ..... A47D 15/00
(52) U.S. Cl. ..... 5/655; 5/494; 128/872
(58) Field of Search ..... 5/494, 655, 485, 5/496; 128/872, 873, 874

(56) References Cited

U.S. PATENT DOCUMENTS

| | | | | | |
|---|---|---|---|---|---|
| 1,964,271 | A | * | 6/1934 | O'Dwyer | 128/873 |
| 2,702,385 | A | | 2/1955 | Goldberg | |
| 2,989,753 | A | | 6/1961 | Burner | |
| 3,093,132 | A | | 6/1963 | Bailey | |
| 3,521,309 | A | | 7/1970 | Evans | |
| 3,832,744 | A | * | 9/1974 | Krarup | 128/873 |
| 3,845,513 | A | * | 11/1974 | Hubner | 2/69.5 |
| 4,172,300 | A | * | 10/1979 | Miller | 5/424 |
| 4,471,767 | A | * | 9/1984 | Guimond | 601/5 |
| 4,597,121 | A | * | 7/1986 | Bouma | 5/494 |
| 4,657,005 | A | | 4/1987 | Williamson | |
| 4,802,244 | A | | 2/1989 | McGrath-Saleh | |
| 4,858,625 | A | | 8/1989 | Cramer | |
| 4,862,535 | A | | 9/1989 | Roberts | |
| 4,989,286 | A | | 2/1991 | Tucker | |
| 5,208,925 | A | | 5/1993 | Edlund | |
| 5,233,714 | A | | 8/1993 | De Bell Daniel | |
| 5,400,803 | A | | 3/1995 | Vines | |
| 5,439,008 | A | | 8/1995 | Bowman | |
| D382,642 | S | | 8/1997 | Van Gisbergen Rutherford | |
| 5,746,219 | A | | 5/1998 | McConnell | |
| 5,800,368 | A | | 9/1998 | Klingemann et al. | |
| 6,095,614 | A | * | 8/2000 | Canna et al. | 297/468 |
| 6,381,785 | B1 | | 5/2002 | Mancera Browne et al. | |

* cited by examiner

*Primary Examiner*—Michael F. Trettel
(74) *Attorney, Agent, or Firm*—McLane, Graf, Raulerson & Middleton, PA

(57) ABSTRACT

A bedding article includes a bottom panel and a top panel for receiving a baby. A plurality of fasteners secure the top and bottom panels and define a openings for receiving the lower torso and legs of the baby. A plurality of fasteners are spaced about the periphery of the bottom panel to releasably secure the bottom panel in a fixed position on a sleeping surface. In another aspect, the bedding article includes additional leg openings to allow selective placement of the child in a prone, supine, or side position. In further aspects, a pouch for receiving a portion of the baby and a garment worn by the baby for attachment to the bottom panel are provided. The bedding articles herein are advantageously used in conjunction with a mattress which is inclined to prevent the subject from sliding down the incline under the influence of gravity.

25 Claims, 9 Drawing Sheets

BEDDING ARTICLE

BACKGROUND OF THE INVENTION

The present invention is directed to a bedding article. It finds particular application in retaining and preventing downward sliding movement of a baby in a crib or other mattress which is inclined, and will be described primarily in reference thereto. However, it will be appreciated that the present invention may be employed in conjunction with all manner of sleep surfaces and children of various ages.

Positional treatment of a child by elevating one side of a crib mattress has proven useful in certain circumstances, such as in the prevention of reflux and alleviating congestion and cold symptoms, thereby helping the child to sleep better. However, if unrestrained, the baby may slide down the inclined mattress and may potentially wind up in a compromising position.

Accordingly, the present invention contemplates a new and improved bedding article which can securely restrain or cradle a child while providing a safe, secure, and comfortable place to sleep.

SUMMARY OF THE INVENTION

In one aspect, a bedding article for releasably retaining a human child on an inclined surface includes a generally planar bottom panel comprising a sheet of material and a top panel comprising a sheet of material which is secured at a first position along its peripheral edge to the bottom panel by a first fastener. Second and third fasteners releasably secure the top panel to the bottom panel at second and third positions, respectively, on the top panel. The second and third fasteners are spaced apart from each other and from the first fastener to define first, second and third openings for receiving a lower torso and first and second legs of the child when the first, second, and third fasteners are in fastened position. A plurality of additional fasteners are attached to and spaced about the peripheral edge of the bottom panel to releasably secure the bottom panel in a fixed position relative to the inclined surface.

In another aspect, a bedding article for releasably retaining a human child on an inclined surface, comprises a generally planar bottom panel comprising a sheet of material a top panel secured to the bottom panel at a first position along its peripheral edge via a first fastener. Second and third fasteners releasably secure the top panel at second and third positions on the top panel, the second and third fasteners spaced apart from each other and from the first fastener, thereby defining first, second and third openings for receiving a lower torso and first and second legs of the child when the child is placed within the bedding article in a supine or prone position and when the first, second, and third fasteners are in fastened position. Fourth and fifth openings are also provided which are adapted to receive the first and second legs when the child is placed in the bedding article in a side lateral position.

In yet another aspect, a bedding article for releasably retaining a human child on an inclined surface, comprises a generally planar bottom panel comprising a sheet of material and a top panel comprising a sheet of material. The top panel is secured about a portion of its peripheral edge to the second surface of the bottom panel. A plurality of additional fasteners are attached to and spaced about the peripheral edge of the bottom panel, the additional fasteners being adapted to releasably secure the bottom panel in fixed position relative to the inclined surface.

In still a further aspect, a bedding article for releasably retaining a human child on an inclined surface, comprises a generally planar bottom panel and a garment adapted to be worn around a pelvic region of the child. A hook-and-pile fastening system releasably secures the garment to the bottom panel. One of the hook component and the pile component is attached to the bottom panel and the other of the hook component and the pile component is secured to the garment. A plurality of additional fasteners are attached to and spaced about the peripheral edge of the bottom panel so as to releasably secure the bottom panel in fixed position relative to the inclined surface.

It is to be understood that both the foregoing general description and the following detailed description are exemplary and explanatory only and are not restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

In the accompanying drawings, which are only for purposes of illustrating preferred embodiments and are not to be construed as limiting the invention.

DESCRIPTION OF EMBODIMENTS

Figure 1:
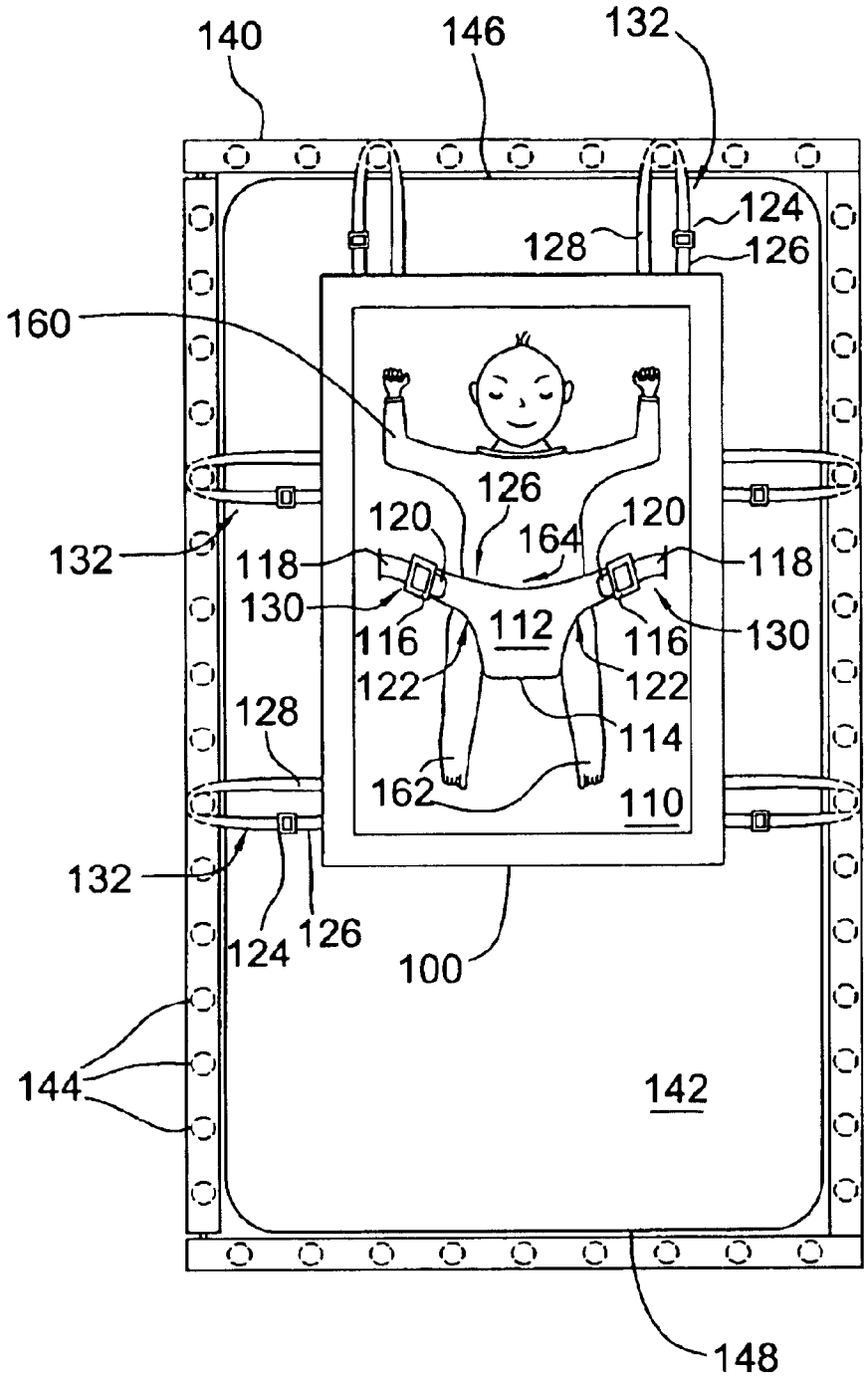
FIG. 1 is a top plan view showing a first embodiment of a bedding article according to the present invention, and illustrating the manner of operation of the present invention.

With reference to FIG. 1, a bedding article 100 in accordance with a first embodiment of the present invention includes a bottom panel 110 and a top panel 112 secured thereto. The top and bottom panels 110 and 112 are each formed of a pliable material, preferably a fabric material. For example, the top and/or bottom panels may be formed of one or more layers of fabric material, such as used in bedding, such as a blanket material, cotton or linen bedsheet material, and the like. In a preferred embodiment, the bottom panel is formed of multiple fabric layers, optionally with batting therebetween. Optionally, a waterproof barrier may be incorporated into or onto the bottom panel 112 for protection of the mattress 142 and any bedding thereon.

In the depicted illustration, the bedding article 100 is placed on the mattress 142 of a conventional crib 140 and there appears a child 160, such as an infant, baby, toddler, or the like, removably retained therein. The bedding article 100 is advantageously used when the mattress 142 is placed at an incline such that the mattress end 146 is elevated with respect to the opposite end 148, is indicated for positional treatment for various physical conditions or diseases, including gastroesophagic reflux and others.

Although the bedding article 100 is depicted as being somewhat smaller than the mattress 142, it will be recognized that the device 100, and particularly the bottom panel 110 thereof, may be any desired size. Preferably, the bottom panel is large enough such that the child 160 is completely accommodated thereon. In this manner, the device 100 may be used directly on the mattress and provides a comfortable sleeping surface, with or without additional bedding underneath, and, may be used to prevent the mattress and any bed clothes underneath from becoming soiled.

Also, the bottom panel 112 may be sized up to the size of the crib or bed being utilized, or, larger wherein the edges of the bottom panel may be folded around and tucked under the mattress. In one preferred embodiment, the dimensions of bottom panel is about 24 inches by 34 inches (61 cm by 86 cm). In another preferred embodiment, the bottom panel is the size of a standard crib mattress, e.g., about 27 inches by 52 inches (69 cm by 132 cm).

In the depicted embodiment, the top panel 112 is generally in the shape of an inverted triangle and is secured to the bottom panel 110 at a position 114 between the legs 162 of the child 160. Preferably, the top panel 112 is secured at position 114 via a permanent fastening means, such as stitching, adhesive, rivets, staples, and so forth, most preferably by permanently stitching the top panel 112 to the bottom panel 110 at the position 114. However, it will be recognized that an alternative fastening means may also be employed, including any of the releasable fastening means described herein.

The top panel 112 further includes two fastening systems 130 attached to the top panel 112 on opposite lateral sides thereof. The fastening systems 130 are located in spaced relation with respect to the attachment point 114 to define two openings 122 for receiving the legs 162 of the baby 160. An opening 126 is defined between the two fastening systems 130 and is adapted to receive the waist or lower torso 164 of the child 160.

Each fastening system 130 includes a fastener 116, which is illustrated generally, and is preferably a releasable fastener. Exemplary releasable fasteners include, for example, hook-and-pile or hook-and-loop type fasteners (e.g., Velcro® fasteners and the like), snaps, clasps, clips, hook-and-eye fasteners, pins, buttons, tie strings, buckles, magnetic catches, and the like. Preferably, the fastener 116 is a snap lock type fastener of the type illustrated and described below by way of reference to FIG. 8.

With continued reference to FIG. 1, the depicted fastening system 130 includes a strap member 120, with the fastener 116 attached to a first end thereof. The second end of the strap member 120 is secured to the top panel 112, preferably in a permanent manner, most preferably via stitching thereto. The fastener 116 is also attached to a first end of a second strap member 118, the second end of the strap member 118 being secured to the bottom panel 110, preferably in a permanent manner, most preferably via stitching thereto.

Preferably, one or both of the strap members 118 and 120 are adjustable in length to accommodate children of varying size. Alternatively, the fastening systems 130 may comprise a fastener having first and second engaging members which are attached directly to the top and bottom panels, respectively.

The bottom panel 110 further includes a plurality of fastening systems 132 spaced about the peripheral edge of the bottom panel 110. Preferably, the number and spacing of the peripheral fasteners is such that the bottom panel will not slide or buckle in any direction. Each fastening system 132 includes a fastener 124, which is illustrated generally, and may be a fastener of the type described above with respect to fastener 116, and is preferably a snap lock type fastener.

In the depicted embodiment, the fastener 124 is attached to a first end of a first strap member 126, the second end of the strap member 126 being secured to the bottom panel 110, preferably in a permanent manner. The fastener 124 is also attached to a first end of a second strap member 128, the second end of the strap member 128 likewise being secured to the bottom panel 110, preferably in a permanent manner.

The strap 128 passes around an adjacent slat or spindle 144 of the crib 140. Preferably, one or both of the strap members 126 and 128 are adjustable in length to accommodate cribs or bed of varying size and/or configuration.

Figure 8:
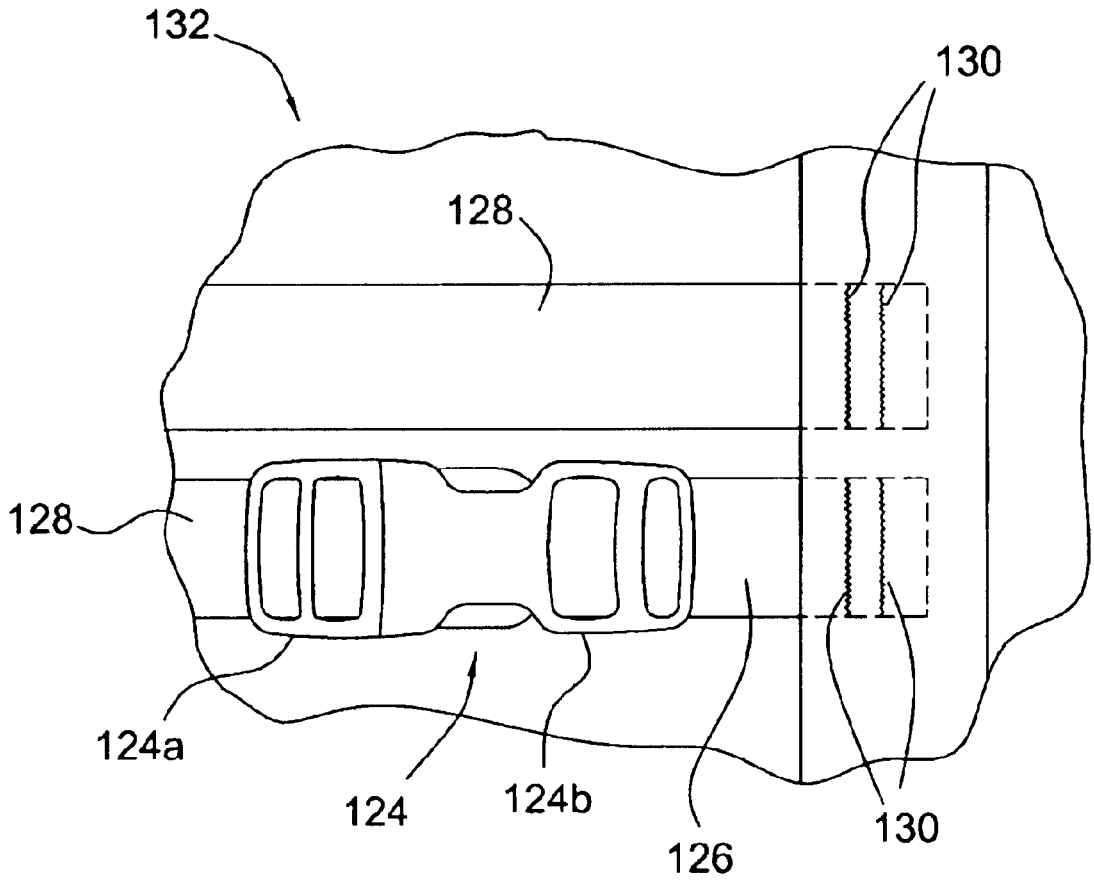
FIG. 8 is an enlarged view of an exemplary fastening system for use with the present invention.

Referring now to FIG. 8, there is shown in greater detail an exemplary fastening system for use in conjunction with the present invention. The preferred fastening system includes a snap lock fastener 124, shown in latched relation, which comprises a first member **124*a* which is removably received within a complimentary receptacle 124*b***.

The fastening member **124*a* is attached to a first end of the strap member 128. The second end of the strap member 128 is secured to the bottom panel 110, preferably in a permanent manner, such as via stitching 130**.

The fastener **124*b* is attached to a first end of the strap member 126, the second end of the strap member 126 being secured to the bottom panel 110, preferably in a permanent manner, such as via stitching 130**.

It will be recognized that other fastener types may be employed for use in fastening systems 130 and/or 132. Exemplary suitable fasteners include, but are not limited to, hook-and-pile type fasteners, snap lock fasteners, snaps, clasps, clips, hook-and-eye fasteners, pins, buttons, ties, buckles, magnetic catches, and the like. It will be recognized that the fastening systems 130 and 132 may advantageously employ the same fastener types, thus reducing the number of different parts and simplifying construction. The description of fastener 124 by way of reference to FIG. 8 for securing the bottom panel relative to mattress 142 is equally applicably to the fasteners herein for securing the top panel to the bottom panel in FIGS. 1, 3A, 3B, 6, and 7.

Figure 2:
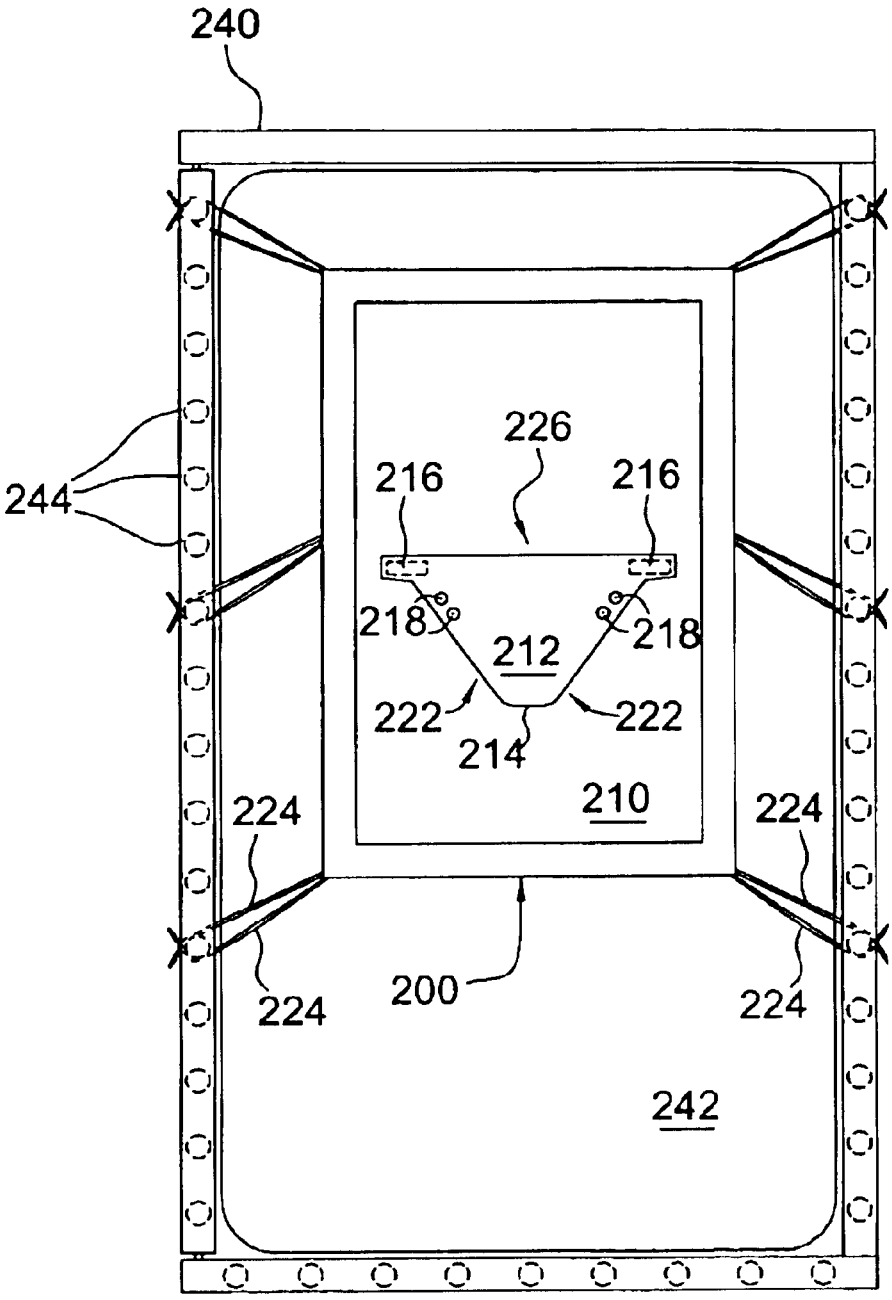
FIG. 2 is a top plan view of a second embodiment of a bedding article according to the present invention.

With reference now to FIG. 2, there is shown a child retention device 200 according to a second embodiment of the present invention. The above description by way of reference to FIG. 1 is applicable to the embodiment of FIG. 2, unless otherwise noted.

The device 200 includes a bottom panel 210 and a top panel 212 secured thereto at an attachment position 214 as described above by way of reference to FIG. 1. The embodiment of FIG. 2 is illustrated in relation to a mattress 242 of a crib 240.

The top panel 212 is similar to top panel 112 of FIG. 1, but instead employs hook-and-pile fasteners 216. Leg openings 222 are defined between attachment point 214 and the lateral side fasteners 216. Torso opening 226 is defined between the two fasteners 216.

The embodiment of FIG. 2 further includes optional snap or buttontype fasteners 218, which may be selectively fastened to adjust the size of the openings 222 to accommodate users of varying size. The fasteners 218 can optionally be disposed along the peripheral edge of the top panel between the two fasteners 216 to render the opening 226 adjustable in size in like manner.

The bottom panel 210 further includes a plurality of fasteners 224 spaced about the peripheral edge of the bottom panel 210. The fasteners depicted include a pair of strings or ties for removable securing the bottom panel 224 to an adjacent slat, spindle, or post 244, or other bed frame member of the crib 240.

Figure 3A:
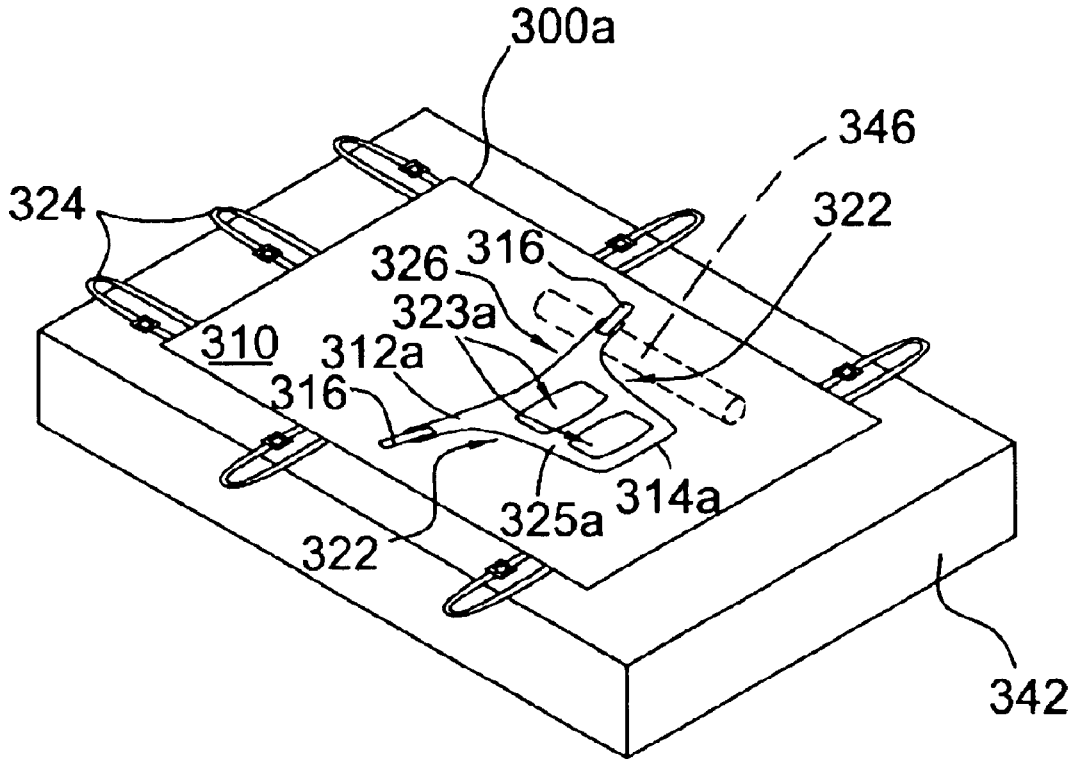
FIGS. 3A and 3B are perspective views of third and fourth embodiments of bedding articles according to the present invention.
Figure 3B:
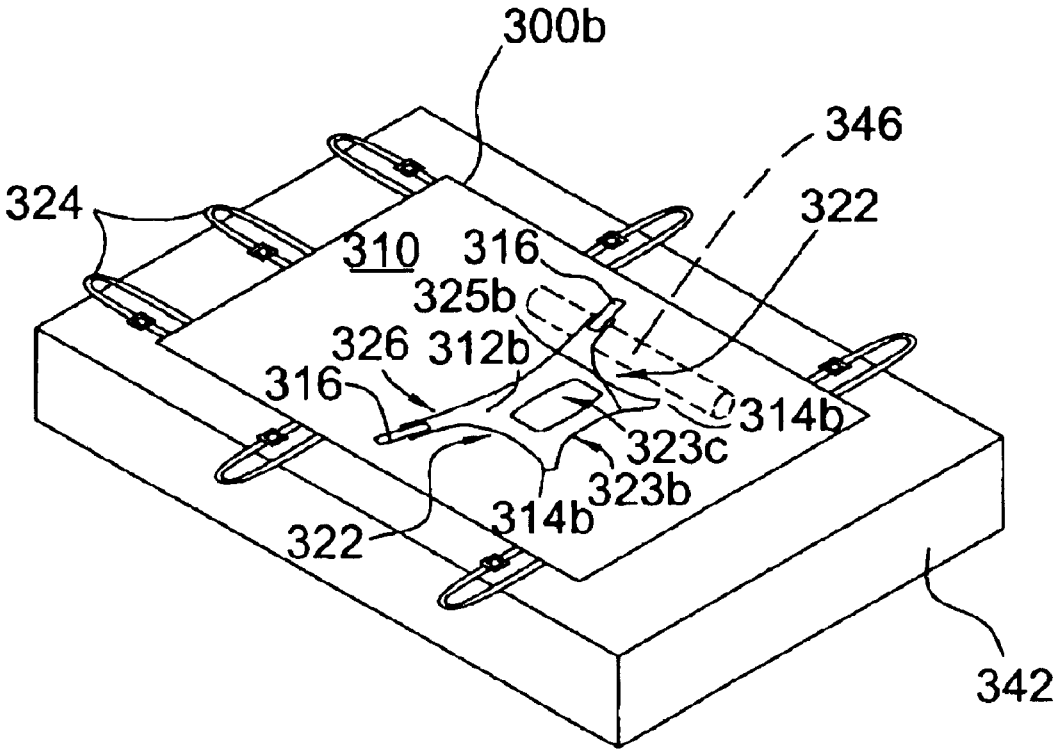

Referring now to FIGS. 3A and 3B, there are shown bedding articles 300*a* and 300*b* in accordance with third and forth embodiments of the present invention. The embodiments of FIGS. 3A and 3B are illustrated in relation to a crib or bed mattress 342, the crib or bed frame itself being omitted for ease of exposition.

Referring to FIG. 3A, the device 300*a* includes a bottom panel 310 and a web-like top panel 312*a* which accommodates multiple sleeping positions. The top panel or web 312*a* is secured to the bottom panel 310 at an attachment position 314*a* in the manner as described above by way of reference to FIGS. 1 and 2. Attachment 314*a* is preferably a permanent attachment.

The top panel 312*a* includes fasteners 316 on opposite lateral sides thereof, which are preferably releasable fasteners. The fasteners 316 may advantageously comprise, for example, hoop-and-pile fasteners, snap lock fasteners, buckles, clasps, or other type of fastener as described herein. Two openings 322 are defined between attachment point 314*a* and the lateral side fasteners 316 for receiving the legs of a child placed within the device 300*a* in either a supine or prone position. An opening 326 is defined between the two fasteners 316 for receiving the lower torso of a child placed therein.

The web 312*a* also includes two adjacent openings 323*a* with a strap 325*a* defined therebetween. The strap 325*a* may be an integral portion of the panel 312*a* or a separately attached member. The size and position of the openings 323*a* are adapted such that each opening receives a leg of a child when placed in a lateral or side position. Optionally, when a baby is placed on a lateral side sleeping position, the device 300*a* can be used in conjunction with a wedge, roll (e.g., a rolled blanket), pillow, or other elongate member 346 (shown in phantom) of a type commonly employed when babies are placed in a lateral sleeping position. Advantageously, the wedge or roll 346 may pass through one of the openings 322, which is otherwise unused when the baby is placed in a lateral position in the depicted illustration, the device 346 is positioned for a baby sleeping on its right lateral side and can be moved to the opposite side for a baby placed on its left lateral side.

Optionally, a removable panel (not shown) may be removably secured over one or each of the openings 323*a* when not in use, i.e., when a baby is placed in a prone or supine position. Each panel may be, for example, a zip-out panel, a panel attached via a hook-and-loop fastener or other releasable fastener, and so forth.

The embodiment of FIG. 3A is shown with generally-depicted fasteners 324, spaced about the periphery of the bottom panel 310, for securing the bottom panel 310 to the frame of a crib or bed, the fasteners preferably comprising snap lock type fasteners. However, other types of fasteners, such as those described herein, are also contemplated. Likewise, additional features disclosed herein may also optionally be employed in conjunction with the embodiment of FIG. 3A, such as snap or button fasteners 218 (see FIG. 2) for adjusting the size of the leg openings 322.

With reference now to FIG. 3B, the bedding article 300*b* includes a bottom panel 310 and a top panel 312*b*, secured thereto at two laterally spaced apart positions 314*b*. The top panel 312*b* includes fasteners 316 on opposite lateral sides thereof, which are preferably releasable fasteners as described above.

Two openings 322 are defined between each attachment point 314*b* and its adjacent lateral side fastener 316 for receiving the legs of a child placed within the device 300*b* in either a supine or prone position. An opening 326 is defined between the two fasteners 316 for receiving the lower torso of a child placed therein.

A first opening 323*b* is defined between the two attachment points 314*b* and is adapted to receive a first leg of a baby when placed in a lateral side position. The web 312*b* also includes a somewhat centrally located opening 323*c* adapted to receive a second leg of a baby when placed in a lateral side position. A strap 325*b* is defined between the openings 323*b* and 323*c*. The strap 325*b* may be integral with the panel 312*b* or a separately attached member.

The size and position of the openings 323*b* and 323*c* are adapted to receive the legs of a child when placed within the device 300*b* in a lateral or side position. Again, optionally, when a baby is placed on a lateral side sleeping position, the device. 300*b* can be used in conjunction with a device 346 (shown in phantom) in the manner described above by way of reference to FIG. 3A.

Optionally, a removable panel (not shown) may be removably secured over one or each of the openings 323*b* and 323*c* when not in use, i.e., when a baby is placed in a prone or supine position. Each panel may be, for example, a zip-out panel, a panel attached via a hook-and-loop fastener or other releasable fastener, and so forth.

Likewise, the embodiment of FIG. 3B is shown with fasteners 324, preferably snap lock type fasteners, spaced about the periphery of the bottom panel 310, for securing the bottom panel 310 to the frame of a crib or bed. Again, it will be recognized that other types of fasteners, such as those described herein, are also contemplated. Furthermore, additional features disclosed herein may also optionally be employed in conjunction with the embodiment of FIG. 3B, such as snap or button fasteners 218 (see FIG. 2) for adjusting the size of the leg openings 322.

Figure 4:
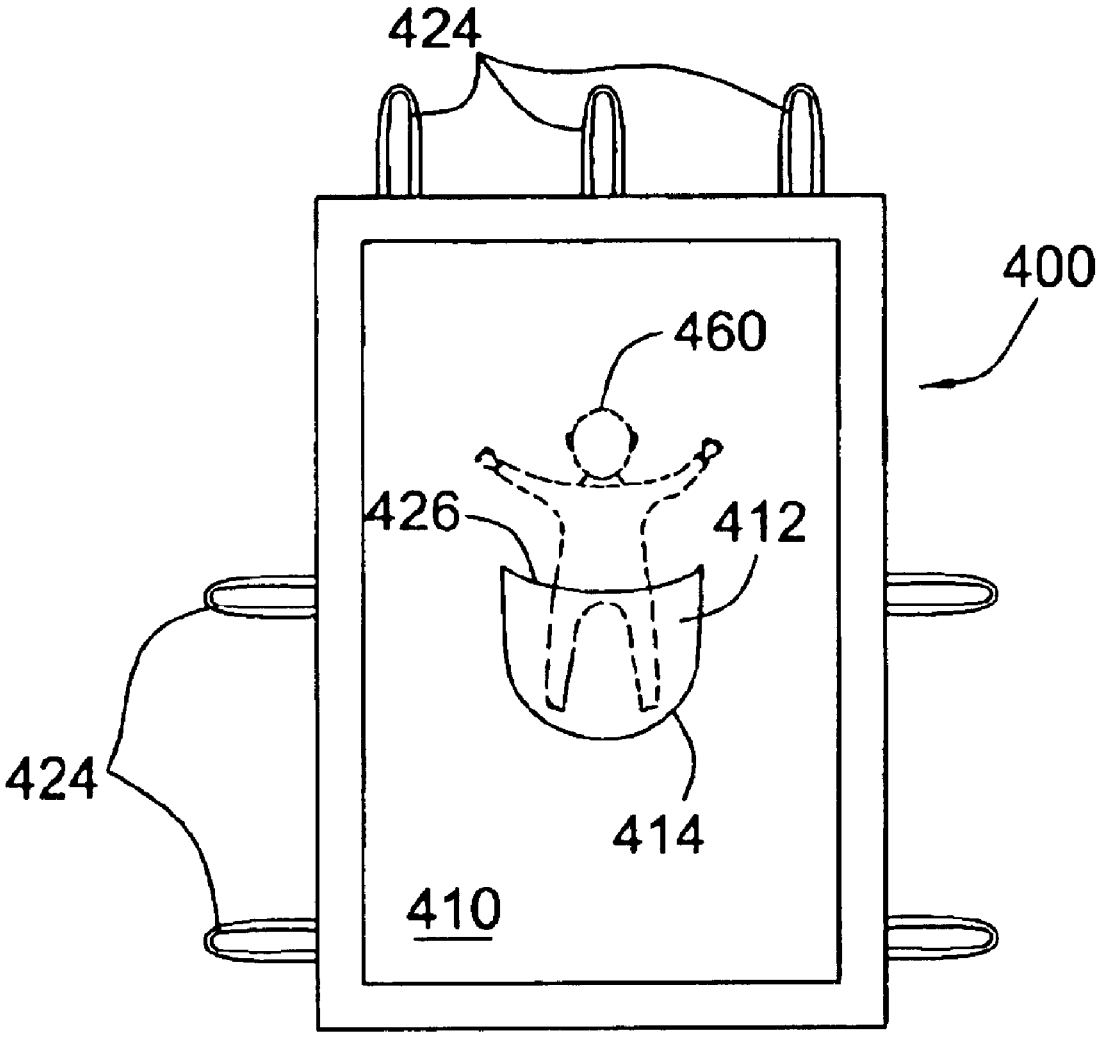
FIG. 4 is a top plan view of a fifth embodiment of a bedding article according to the present invention.

Referring now to FIG. 4, there is shown a further bedding article embodiment 400 in accordance with the present invention. The device 400 includes a bottom panel 410 and a top panel 412 secured thereto. The top panel 412 is secured about a portion of its peripheral edge to the bottom panel 410, preferably via a secure fastening means 414. The top panel 412 is preferably attached preferably via stitching, although other fastener types are contemplated as well, such as a zipper type fastener or a series or snaps, buttons, or other fastener types as described herein.

An opening 426 is formed at the upper peripheral edge of the top panel 412, thereby forming a pouch adapted to receive the legs and lower torso of a child 460 placed therein. The bottom panel 410 further includes a plurality of fasteners 424, which may be any of the types described herein, spaced about the periphery of the bottom panel 410 for securing the device 400 to slats or frame members of a crib or bed (not shown).

Figure 5:
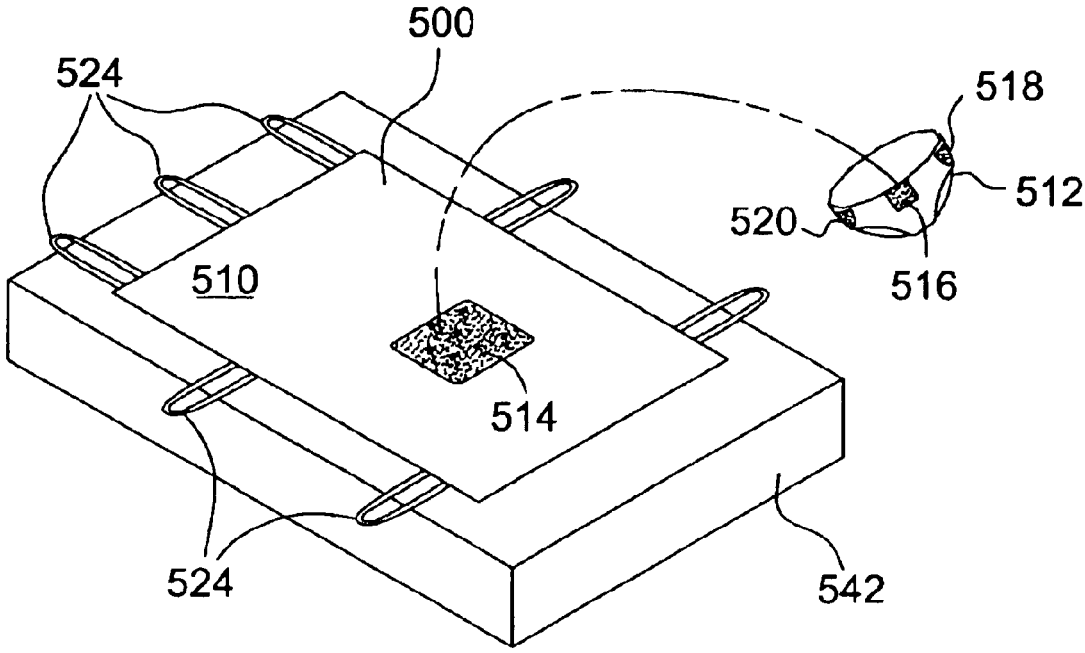
FIG. 5 is a perspective view of a sixth embodiment of a bedding article according to the present invention.

Referring now to FIG. 5, there appears a bedding article 500 according to yet another embodiment of the present invention, shown in relation to a mattress 542. The device 500 comprises a bottom panel 500 having a plurality of fasteners 524 spaced about the peripheral edge thereof for fastening to the slats, frame or posts of a crib or bed (not shown). The fasteners 524 may be of a type described above. The device 500 further includes a garment 512 which is worn around the pelvic region of a child employing the device. The garment 512 may be disposable or washable. The garment 512 may a diaper-type garment which unfolds and is fastened on the lateral sides thereon, or, alternatively, may be in the form of briefs, trunks, pants, training underwear, a pull-on type diaper, or the like.

A hook-and-pile fastening system is employed to secure the garment 512 to the bottom panel 510. For example, a sheet, patch, or strip 514 of a hook material comprising one-half of a hook-and-loop fastener is attached to the bottom panel 510, preferably via a permanent attachment means, such as stitching, adhesive, staples, or the like. Likewise, one or more sheets or strips of a pile material which is adapted to removably engage the hook fastener 514, are attached, preferably in a permanent manner, to the garment 512. In the illustrated embodiment, a sheet, strip, or patch of pile material 516 is placed in a generally central position on the garment 512 allowing a child wearing the garment to be placed in a prone or supine (preferred) position, depending on whether the patch 516 is positioned in the front or rear of the child when the patch 516 is secured to the patch 514.

Optional patches 518 and 520 are placed on the opposite lateral sides of the garment 512, allowing selective placement of the child in either lateral side position when the pile material 518 or 520 is placed in contact with the hook material 516. Another optional patch (not shown) may be placed on the garment opposite the patch 516 to allow selective placement of the child in a prone or supine position. In the depicted example, the pile material 516, 518, and 520 appear as segmented strips or patches. Alternatively, the pile material may be in the form of a continuous band or circular or semicircular segment to allow selective placement of a child wearing the garment 512 in any desired sleeping position.

Alternatively, the patch 514 may be a pile fastening component and the patches 516, 518, and 520 (or, alternative, a continuous strip or band) may be a complimentary hook component. Optionally, the unused patches (or portions thereof) on the garment 512 may be covered for comfort of the wearer when not in use.

Figure 6:
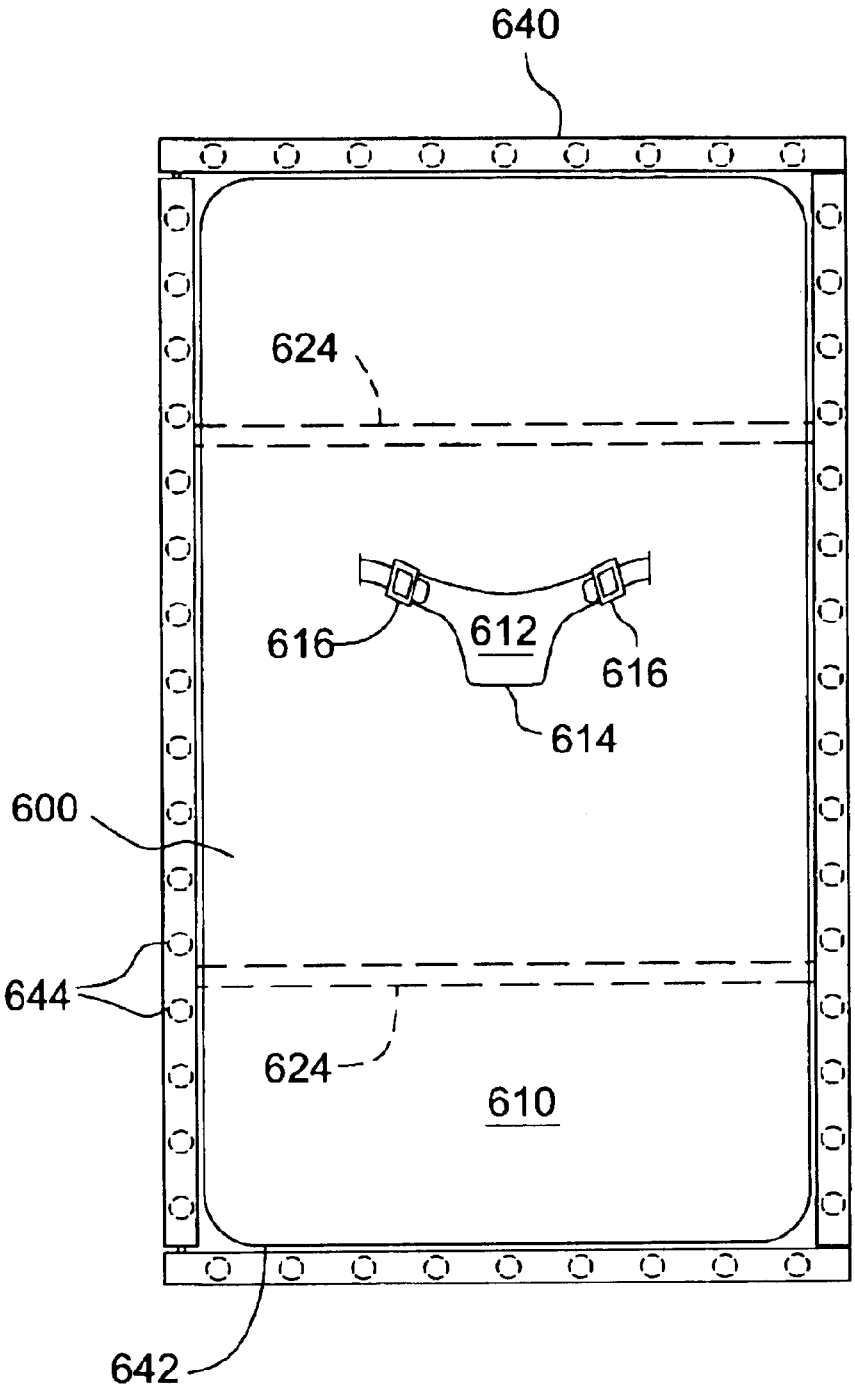
FIG. 6 is a top plan view of a seventh embodiment of a bedding article according to the present invention.
Figure 7:
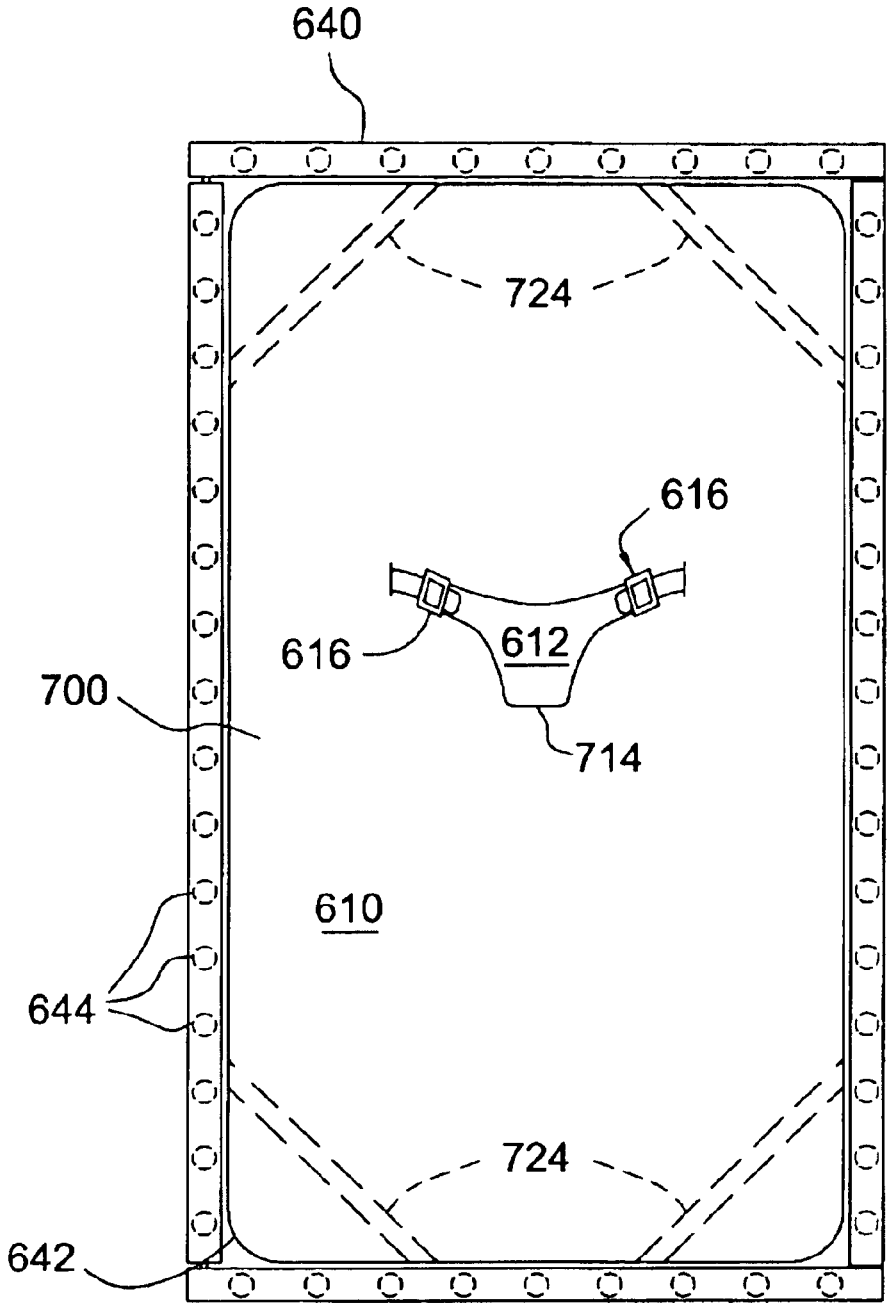
FIG. 7 is a top plan view of an eighth embodiment of a bedding article according to the present invention.

Referring now to FIGS. 6 and 7, there are shown two embodiments 600 and 700, respectively, of the present invention, which are sized to conform to a specific mattress size in fitted manner. The devices 600, 700, each comprise a bottom panel 610 and a top panel 612. The bottom panel 610 is configured to engage a mattress 642 of a crib 640 or other bed, e.g., in the manner of a fitted sheet or blanket. Alternatively, the bottom panel may be larger than the mattress 642, wherein the edges are tucked under the mattress to secure the panel 610 relative to the mattress 642. Optional straps 624 (FIG. 6) or 724 (FIG. 7) passing under the mattress 642 may also be used to further secure the device (600, 700) to the mattress 642.

In the depicted embodiments, the top panel 612 appears as a diaper-type sling which is attached to the bottom panel 610 at an attachment point 614 and wherein fasteners 616 are employed to secure the lateral sides of the top panel 612 to the bottom panel 610. However, any of the alternative top panel embodiments and fastening means as described above by way of reference to FIGS. 1–5 may also be employed in connection with the bottom panel 610. In this manner, the bedding article 600, 700, may be secured with respect to the crib or bed without attaching the bottom panel 612 directly to the crib or bed frame.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A bedding article for releasably retaining a human child on an inclined surface, comprising:

a generally planar bottom panel comprising a sheet of material and having a first surface adapted to face said inclined surface and a second surface opposite the first surface, said bottom panel being bounded by a peripheral edge;

a top panel comprising a sheet of material, said top panel being bounded by a peripheral edge;

a first fastener securing said top panel at a first position along its peripheral edge to the second surface of the bottom panel;

second and third fasteners releasably securing said top panel at second and third positions, respectively, on the top panel to said second surface of the bottom panel;

said second and third fasteners being spaced apart from each other and from said first fastener, thereby defining first, second and third openings for receiving a lower torso and first and second legs of said child when said first, second, and third fasteners are in fastened position; and a plurality of additional fasteners attached to and spaced about the peripheral edge of the bottom panel, said additional fasteners being adapted to releasably secure said bottom panel in a fixed position relative to said inclined surface.

2. The bedding article of claim 1, wherein said bottom panel and said top panel are formed from a fabric material.

3. The bedding article of claim 1, wherein said bottom panel is formed from a material selected from a blanket material and a quilted material.

4. The bedding article of claim 1, wherein said bottom panel is formed from a moisture-absorbent material.

5. The bedding article of claim 1, wherein said bottom panel is sized to completely receive said human child thereon.

6. The bedding article of claim 1, wherein said bottom panel is generally rectangular in shape and the top panel is generally triangular in shape.

7. The bedding article of claim 1, wherein said child is an infant.

8. The bedding article of claim 1, wherein said first fastener is a permanent fastener.

9. The bedding article of claim 1, wherein said second and third fasteners are selected from the group consisting of hook-and-pile fasteners, snaps, clasps, clips, hook and eye fasteners, pins, buttons, tie strings, buckles, and magnetic catches.

10. The bedding article of claim 1, wherein said first fastener is stitching and said second and third fasteners are snap lock fasteners.

11. The bedding article of claim 1, wherein said second and third fasteners are hook-and-pile fasteners.

12. The bedding article of claim 1, further comprising at least one additional fastener disposed on the top panel configured to adjust the size of at least one of said first, second, and third openings.

13. The bedding article of claim 1, wherein said additional fasteners comprise adjustable length straps.

14. The bedding article of claim 1, wherein said first, second and third openings are configured to receive said lower torso and two legs of said child, respectively, when said child is placed within the bedding article in a supine or prone position, said bedding article further comprising:

fourth and fifth openings adapted to receive said first and second legs when said child is placed in said bedding article in a lateral side position.

15. The bedding article of claim 14, wherein said fourth and fifth openings are apertures formed in said top panel.

16. The bedding article of claim 14, wherein said fourth opening is an aperture formed in said top panel and said fifth opening is an opening defined between said bottom panel and a peripheral edge of said top panel.

17. The bedding article of claim 16, further comprising a fourth fastener securing said top panel at a position along its peripheral edge, adjacent to said first fastener, to the second surface of the bottom panel, wherein said fifth opening is defined between said first and fourth fasteners.

18. The bedding article of claim 1, wherein:

said inclined surface is a mattress retained within a crib; and said additional fasteners comprise strap members disposed about the periphery of the bottom panel and adapted to removably engage a portion of said crib.

19. The bedding article of claim 18, wherein said additional fasteners are adapted to engage one or more of slats, posts, and frame members of said crib.

20. A bedding article for releasably retaining a human child on an inclined surface, comprising:

a generally planar bottom panel comprising a sheet of material and having a first surface adapted to face said inclined surface and a second surface opposite the first surface, said bottom panel being bounded by a peripheral edge;

a top panel comprising a sheet of material, said top panel being bounded by a peripheral edge;

a first fastener securing said top panel at a first position along its peripheral edge to the second surface of the bottom panel;

second and third fasteners releasably securing said top panel at second and third positions on the top panel, respectively, to said second surface of the bottom panel;

said second and third fasteners spaced apart from each other and from said first fastener, thereby defining first, second and third openings for receiving a lower torso and first and second legs of said child, when said child is placed within the bedding article in a supine or prone position and when said first, second, and third fasteners are in fastened position; and fourth and fifth openings adapted to receive said first and second legs when said child is placed in said bedding article in a side lateral position.

21. The bedding article of claim 20, wherein said fourth and fifth openings are apertures formed in said top panel.

22. The bedding article of claim 20, wherein said fourth opening is an aperture formed in said top panel and said fifth opening is an opening defined between said bottom panel and a peripheral edge of said top panel.

23. The bedding article of claim 22, further comprising a fourth fastener securing said top panel at a position along its peripheral edge, adjacent to said first fastener, to the second surface of the bottom panel, wherein said fifth opening is defined between said first and fourth fasteners.

24. The bedding article of claim 20, further comprising a plurality of additional fasteners attached to and spaced about the peripheral edge of the bottom panel, said additional fasteners being adapted to releasably secure said bottom panel in fixed position relative to said inclined surface.

25. A bedding article for releasably retaining a human child on an inclined surface, comprising:

a generally planar bottom panel comprising a sheet of material and having a first surface adapted to face said inclined surface and a second surface opposite the first surface, said bottom panel being bounded by a peripheral edge;

a garment adapted to be worn around a pelvic region of the child;

a hook-and-pile fastening system for releasably securing said garment to said second surface of the bottom panel comprising a hook component and a complimentary pile component;

one of said hook component and said pile component being attached to said bottom panel and the other of said hook component and said pile component being secured to said garment;

a plurality of additional fasteners attached to and spaced about the peripheral edge of the bottom panel, said additional fasteners being adapted to releasably secure said bottom panel in fixed position relative to said inclined surface; and said other of said hook component and said pile component comprising one of:

a strip of fastener material extending at least partially around the pelvic region of said child; and a segmented band of fastener material extending at least partially around the pelvic region of said child.

* * * * *